US005769434A

United States Patent [19]

Wurthner

[11] Patent Number: 5,769,434

[45] Date of Patent: Jun. 23, 1998

[54] SPORTS EQUIPMENT OR VEHICLES WITH RUNNERS WITH INTERCHANGEABLE BLADE

[76] Inventor: Holger Wurthner, Esslinger Strasse 23, D-78054 Villingen-Schwenningen, Germany

[21] Appl. No.: 403,927

[22] PCT Filed: Sep. 24, 1993

[86] PCT No.: PCT/DE93/00913

§ 371 Date: Mar. 22, 1995

§ 102(e) Date: Mar. 22, 1995

[87] PCT Pub. No.: WO94/08668

PCT Pub. Date: Apr. 28, 1994

[30] Foreign Application Priority Data

Oct. 8, 1992 [DE] Germany ..... 42 33 880.8

[51] Int. Cl.[6] ..... A63C 1/32

[52] U.S. Cl. ..... 280/11.18; 280/11.12

[58] Field of Search ..... 280/11.18, 11.16, 280/841, 825, 11.12, 7.13

[56] References Cited

U.S. PATENT DOCUMENTS

| | | | |
|---|---|---|---|
| 1,670,226 | 5/1928 | Anderson | 280/11.18 |
| 2,108,128 | 2/1938 | Kinney | 280/11.18 |
| 3,212,786 | 10/1965 | Florjancic et al. | 280/11.12 |
| 3,785,662 | 1/1974 | Staples | 280/11.18 |
| 3,947,050 | 3/1976 | Isely | 280/11.18 |
| 4,088,335 | 5/1978 | Norton | 280/11.18 |
| 4,131,288 | 12/1978 | Wilson | 280/11.18 |
| 4,218,069 | 8/1980 | Baikie | 280/11.12 |
| 4,379,563 | 4/1983 | Arsenault | 280/11.18 |
| 5,383,674 | 1/1995 | Cann et al. | 280/11.18 |
| 5,484,148 | 1/1996 | Olivieri | 280/11.18 |

FOREIGN PATENT DOCUMENTS

| | | | |
|---|---|---|---|
| 94005381 | 3/1994 | WIPO | 280/11.18 |

*Primary Examiner*—Anne Marie Boehler
*Attorney, Agent, or Firm*—Gary M. Nath; Nath & Associates; Harold Novick

[57] ABSTRACT

A skating appliance or vehicle having a skate with a plastic base and a composite running blade exchangeably secured thereto. The exchangeable composite running blade is secured with the high resistance to torsion and flexure as well as high security against fracture, by means of an on edge mounted profiled stabilizing rail set into the lower side of the base, and easy to handle screwable holding members, and a corresponding design of the individual parts. These elements allow an arrangement to be obtained which as a whole has a low weight and a high resistance to pressure.

23 Claims, 10 Drawing Sheets

FIG. 19
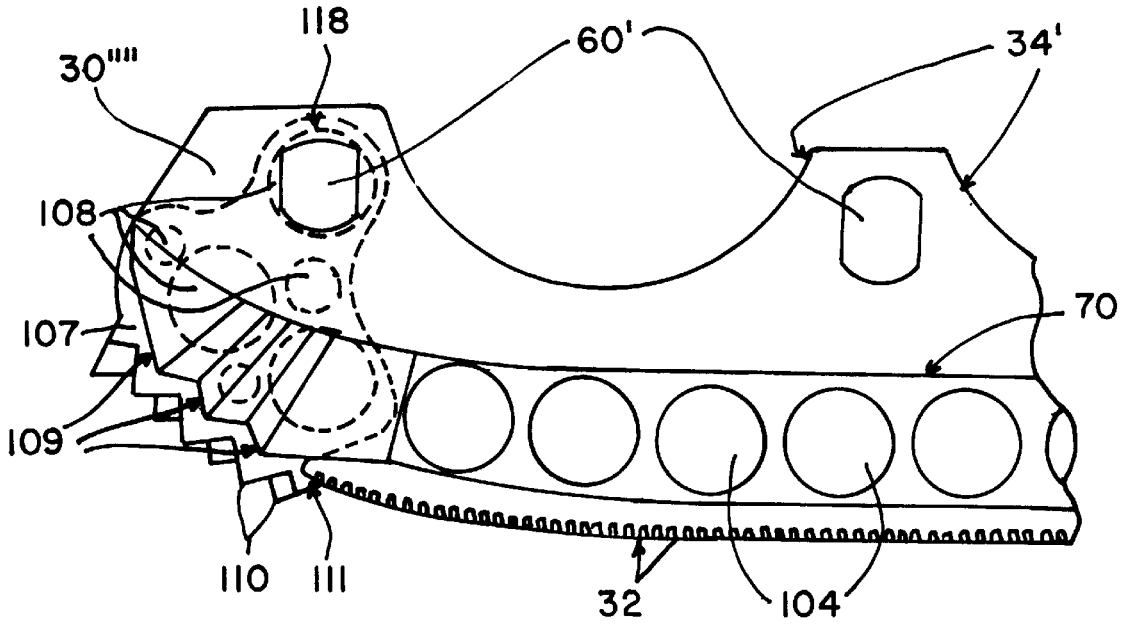
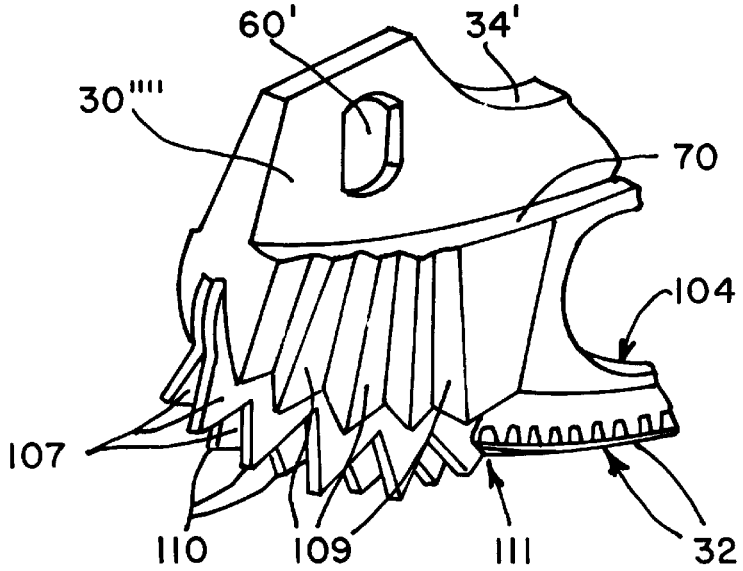
FIG. 20

SPORTS EQUIPMENT OR VEHICLES WITH RUNNERS WITH INTERCHANGEABLE BLADE

BACKGROUND OF THE INVENTION

1. Field of the Invention

The invention pertains to sports equipment or vehicles with runners.

An ice skate with a basic unit attached to the sole of a boot and interchangeable runner blade attached of thereto is known from EP-427,920 A1. In this case the blade is clamped only at its front and rear ends by actuating a lever mechanism and is, moreover, sealed in shallow groove on the bottom of the basic unit consisting of plastic. It is not possible to achieve very substantial protection against warping and torsion of the parts joined together with this type of fastening.

The invention is intended to improve sports equipment or vehicles with runners in such a way that outstanding protection against warping and torsion is achieved at low overall weight and low manufacturing costs, with guaranteed exact fastening of the interchangeable and dimensionally precisely manufactured runner blade.

This problem is solved for sports equipment with runners.

Due to the stabilization rail and the nut-screw connections distributed over the entire length of the runner blade, which are very simple to install, outstanding bending strength and resistance to warping are achieved with a relatively light weight.

The subordinate claims pertain to advantageous refinements of the invention.

SUMMARY OF THE INVENTION

Thus, it is practical for the stabilization rail to be formed from a shaped rod.

The runner blade preferably consists of economical light metal or plastic and bears contact blade made of considerably more expensive resilient material. This allows the manufacturing costs for the interchangeable blades to be considerably reduced, as are the edge wear and risk of breakage of the blade.

Gripping ridges are seated on the contact blade and embedded in the material of the runner blade during injection molding to provide for a secure seating of the contact blade, which is subject to specific bending and shearing forces.

This feature makes possible an additional weight reduction of the runner while maintaining the high warping resistance and bending strength. The transverse cutouts and mounting devices therefore alternate over the entire length of the runner.

The upper rim of the stabilization rail surrounds the lower peripheral sections of the transverse cutouts in roughly a wave shape and in this way it optimally utilizes the fastening opportunities.

Either the stabilization rail can held in a vertical slit of the runner blade or the runner blade can be held in a vertical slit of the stabilization rail, with the insertion of the components inside one another further enhancing the stability of the arrangement.

Practical pertain to practical configurations of the retaining devices and the parts of the runner cooperating with them in order to achieve an easily assembled and secure fastening of the runner blade on the basic unit and the stabilization rail.

The basic unit may also be produced from economical and/or particularly light and warp-resistant material. The stabilization rail configured as a shaped rod consists preferably of light metal or carbon fiber material, such as Kevlar.

An even better anchoring of the basic unit to the sole of a skate boot is achieved by this arrangement.

Applicant's structure offers additional weight reduction of the basic unit and the runner blade.

Additional practical configurations of the mountain devices and the parts of the runner cooperating with them ease the mounting of a runner blade on the basic unit.

The runner blade is provided with a serrated steel blade arranged in the front area, which is particularly suited to figure skating and general recreational skating.

BRIEF DESCRIPTION OF THE DRAWINGS

Embodiment examples of the invention are explained the basis of the figures. These show in FIG. 1 a schematic side view of a first embodiment of an ice skate boot according to the invention;

FIG. 19 a partial side view of the front end of a runner blade with serrated steel blade according to a fifth embodiment of the invention; and FIG. 20 an oblique view of the front end of the runner blade used in the embodiment according to FIG. 19.

The same reference numerals are used in all figure for identical or corresponding parts. The expressions "vertical," "horizontal," "above" and "below" refer only to the upright normal position of the various embodiment of an ice skate boot.

DETAILED DESCRIPTION OF THE PREFERRED EMBODIMENT

Figure 1:
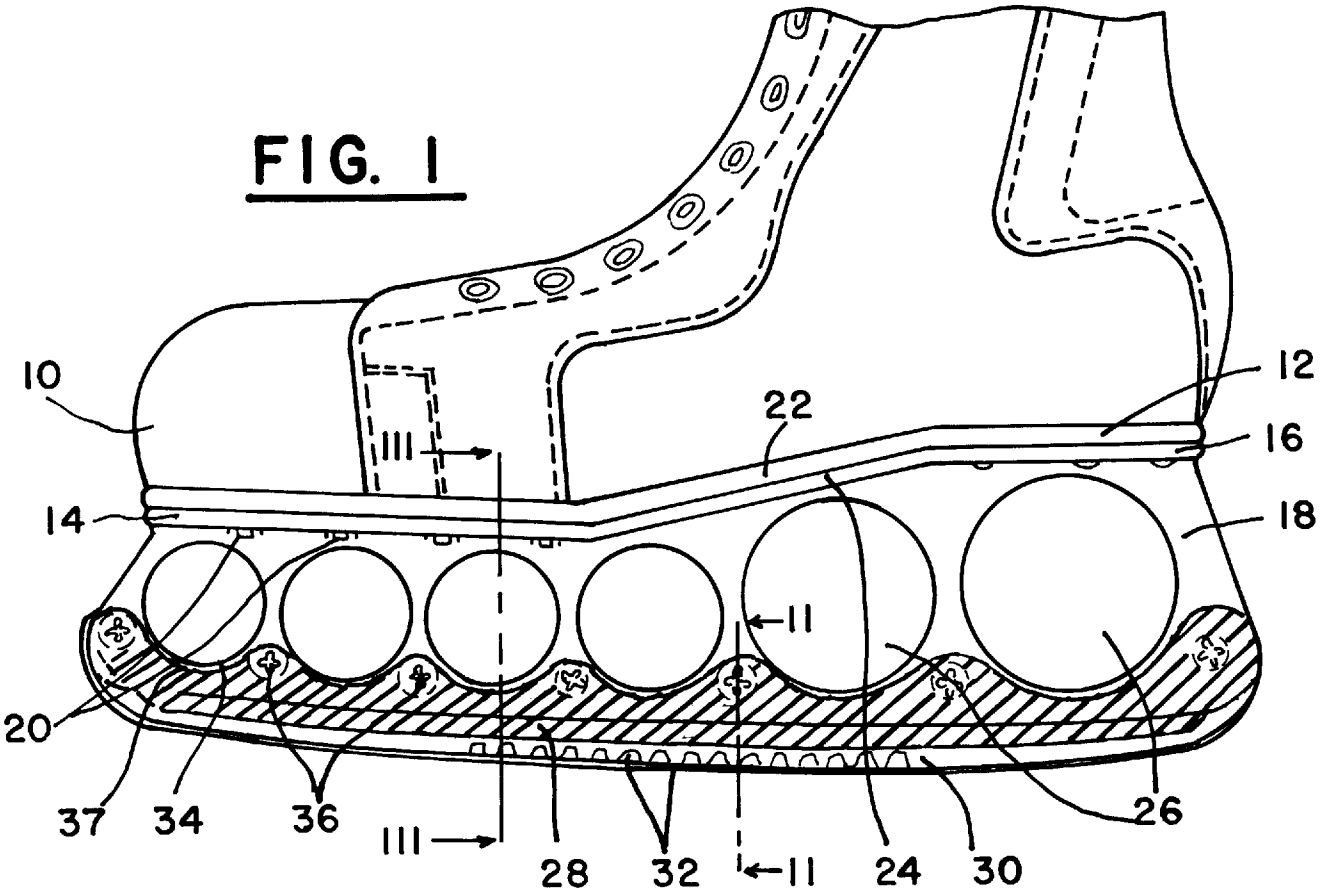
Figure 2:
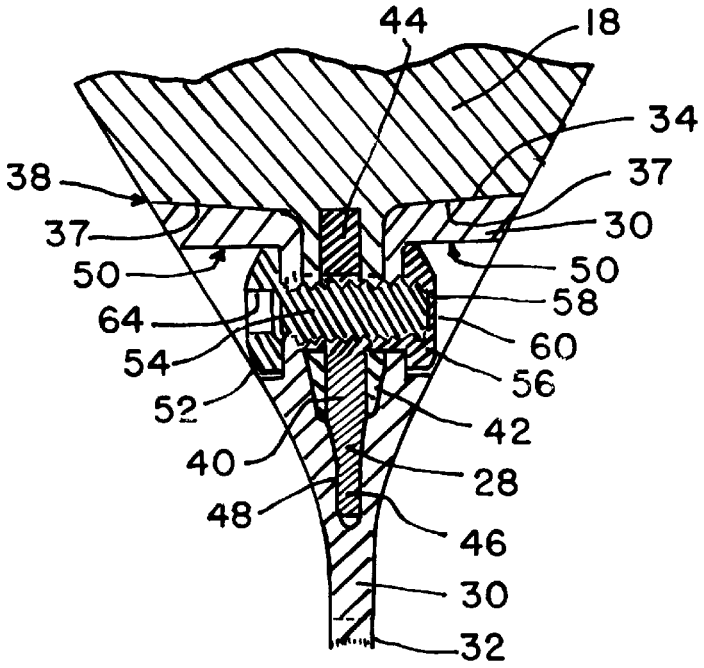
FIG. 2 a partial section along the line II—II in FIG. 1.
Figure 3:
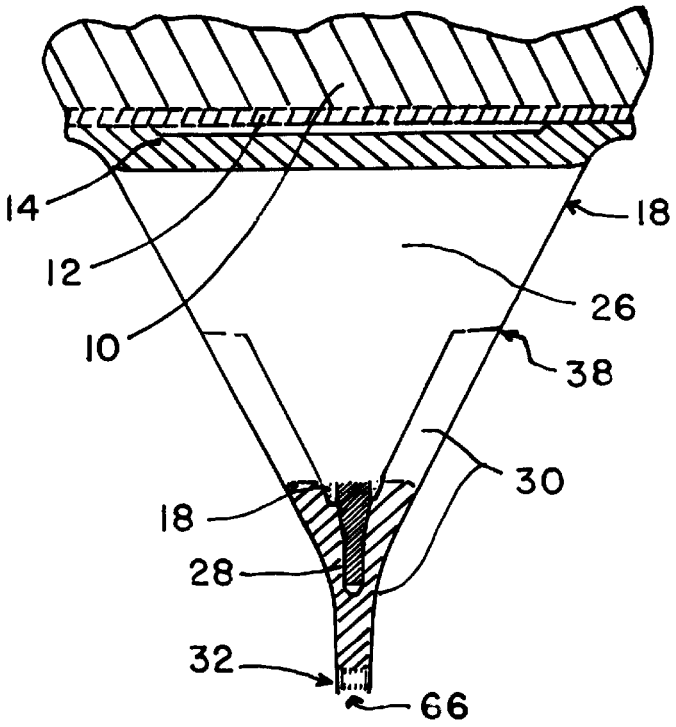
FIG. 3 an enlarged partial section along the line III—III in FIG. 1.

In the embodiments shown in FIGS. 1–5, an ice skate boot 10 is provided with a continuous sole 12. A flat sole plate 14 and a likewise flat heel attachment plate 16 of a slim base runner base unit 18 made of hard plastic or carbon fiber (Kevlar) are fastened to the sole in conventional manner by means of screws 20. For angular compensation, the base unit 18 has, in the slanted middle section 22 of the sole 12, a recess 24 rather than a plate in contact with the sole 12. For additional weight reduction, the base unit 18, slim and made of lightweight material in any case, has a series of tubular transverse cutouts 26 which run from its front to its rear end, spaced a slight distance apart, and occupy the greater part of its horizontal and vertical dimensions. A sufficiently stable framework remains between and around the transverse cutouts 26 of the base unit 18 in order to achieve the required bending strength and resistance to warping, as well as fracture resistance. The rigidity, but also a certain desired flexibility of the base unit 18, can be determined and modified by changes of the wall thickness in certain parts of the base unit as well as by changing the shaping and material selection of the stabilization rail 28, 28'.

In a manner to be explained in more detail below, continuous, flat stabilization rail 28 made of light metal, running over essentially the entire length of the base unit 18, and standing on edge, is injection-molded into the base unit; for greater clarity, it is shown cross-hatched in FIG. 1 in order to distinguish it from the other parts. The stabilization rail 28 is gripped on both sides by a runner blade 30, which bears a contact blade 32 injected into the material of the runner blade and bent upwards at its front and rear ends in the usual manner. The upper rim 34 of the runner blade 30, which roughly coincides in this embodiment with the upper edge of the stabilization rail 28, as seen from the side, extends roughly in a wave shape and is adapted to the lower part of the contours of the transverse cutouts 26, so that two wave crests of the upper edge 34 are arranged, respectively, on either side of each transverse cutout 26. In the area of each wave crest there is a retaining device, generally labeled 36 and discussed in greater detail below, that serves to detachably fasten the runner blade 30 to the base unit 18. The contact blade 32 can be designed as an extremely thin metal gliding surface with a thickness of, for instance, roughly 0.8 mm. When the contact blade 32 slides over ice, a rapid warming due to friction occurs in the area in contact with the runner blade 30. Due to the heat-insulating effect of the plastic, of which the runner blade 30 preferably consists, the heat formed cannot flow away. While skating, this results in a clearly higher temperature of the contact blade 32. The fast and lasting heating, in turn, influences water formation between the contact blade 32 and the ice, the sliding medium. The result is an effort-sparing and faster skating than with all known ice skating equipment.

The base unit 18, the stabilization rail 28, and the runner blade 30, as well as the detachable fastening of the latter, are illustrated in greater detail in FIGS. 2–5. The upper edge 34 of the runner blade 30 together with the correspondingly shaped lower edge of the recesses 37 on both sides of the base unit 18 forms a continuous connection joint 38, along which the two components make close contact. In the middle of the cross section (see FIG. 2) the runner blade 30 has an essentially vertical slot 40 opening upward, in which a projection 42 of the base unit 18 makes a flush engagement. An upper section 44 of the stabilization rail 28 is securely injected [sic embedded by injection molding] or glued into the projection 42. A lower section 46 of the stabilization rail 28 sticking out from the projection 42 is tightly inserted into a thinned-out lower section 48 of the slit 40, so that, together with the butt joint 38, a flawless seating of the runner blade 30 on the base unit 18 is guaranteed. The outer surfaces of the parts 18 and 30 adjoin flushly and smoothly at the butt joint 38.

In the area of the wave crests of the upper edge 34, the runner blade has a recess 50 on both sides for accommodating the head 52 of a cap screw 54 or the head 56 of an extended nut 58, so that the latter do not project above the surface of the runner blade 30. The clap screw 54 and the extended nut 58 together constitute a retaining device 36 for fastening the runner blade 30 to the base unit 18 and, in the assembled state shown in FIGS. 2 and 4, pass through a transverse opening 60 of the runner blade 30 and the stabilization rail 28, as well as the projection 42 of the base unit 18, running from one recess 50 to the opposite recess 50. The extension of the extended nut 58 has two opposing antirotation surfaces 62, which make close contact with corresponding antirotation surfaces 63 of the transverse opening 60. In this way, the extended nut 58 is automatically held in place against rotation during insertion of the cap screw 54. To make the insertion of the cap screw 54 easy, its head 52 has an internal polygonal socket 64. This construction of the retaining device 36 makes possible an easy and simultaneously secure attachment of the runner blade 30 to the base unit and the same kind of detachment when wear of the contact blade 32 makes exchange of the runner blade 30 necessary. The cooperation of the retaining devices 36 with the stop surfaces and stabilization measures provided results in an extraordinarily stable, bending- and torsion-resistant seating of the runner blade 30 on the base unit 18.

Figure 4:
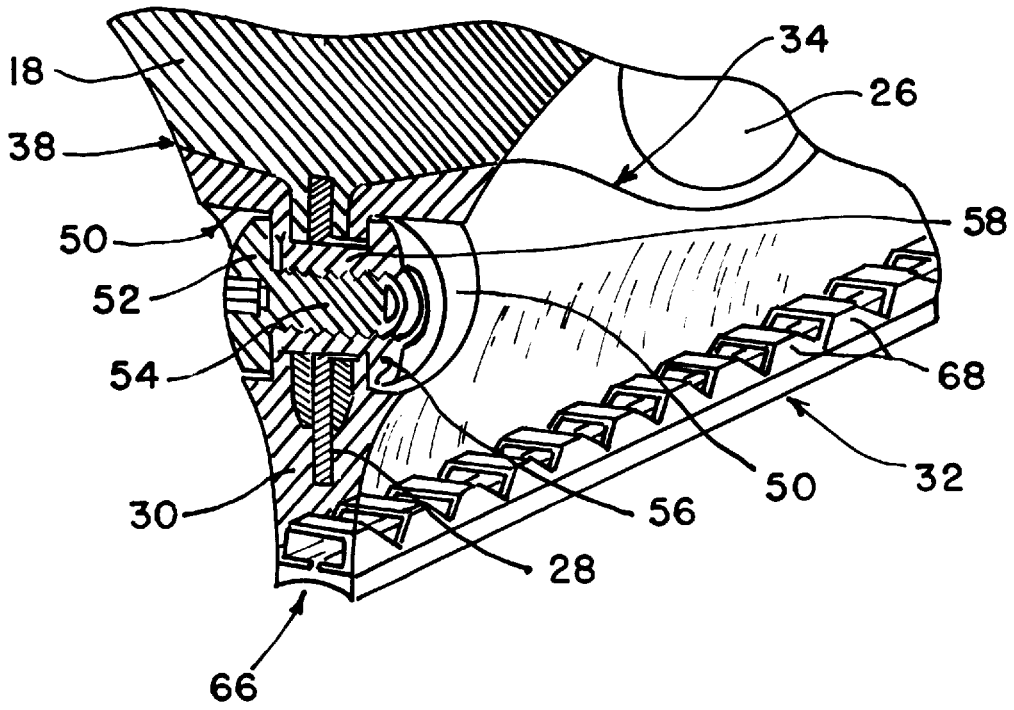
FIG. 4 a partial oblique view at roughly the position of the line II—II in FIG. 1, in which the contact blade is drawn as if the material of the runner blade were transparent, for the sake of greater clarity.
Figure 5:
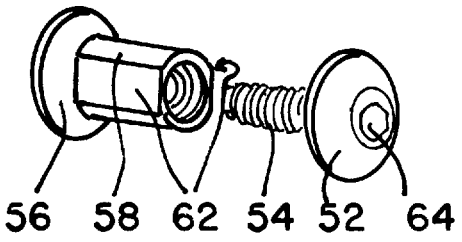
FIG. 5 an exploded oblique view of a retaining device consisting of an extended nut and cap screw.
Figure 6:
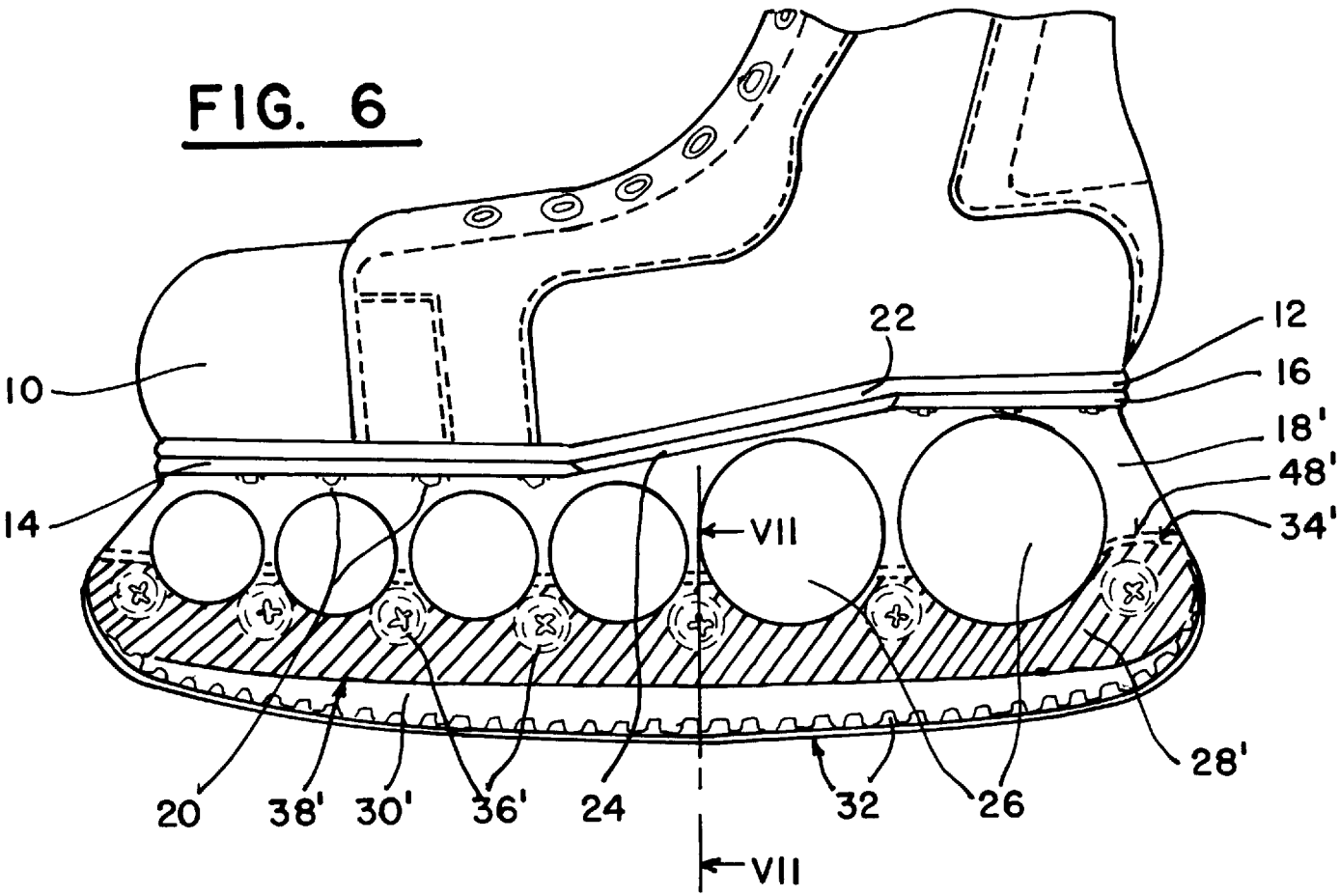
FIG. 6 a schematic side view corresponding to FIG. 1 of a second embodiment of an ice skate boot according to the invention.
Figure 7:
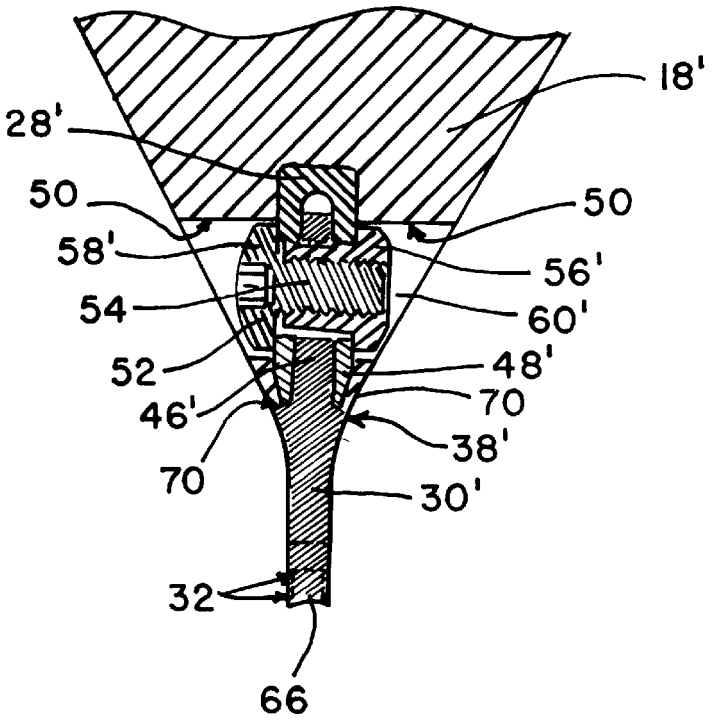
FIG. 7 a partial section along the line VII—VII in FIG. 6.
Figure 8:
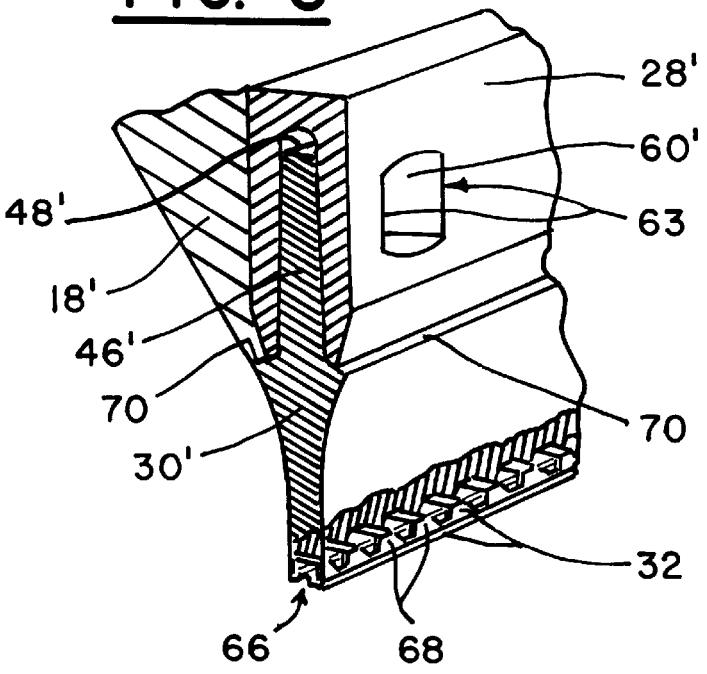
FIG. 8 a side view of the embodiment according to FIG. 6 corresponding roughly to FIG. 4, with a part of the basic unit broken away for the sake of greater clarity.
Figure 9:
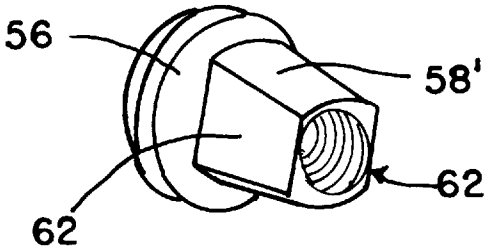
FIG. 9 an oblique view of an extended nut and cap screw being used for the retaining devices in the embodiment example according to FIG. 6.

The contact blade, labeled 32 as a whole, has a band-shaped part 66 of metal as a gripping part welded to it, which has gripping ridges 68 that are preferably embedded in the material of the runner blade 30 by injection molding. The gripping ridges 68 are boxes open in the axial direction of the contact blade 32 with trapezoidal side faces, by means of which the material of the runner blade 30 can penetrate into the gripping ridges 68, and the latter are connected to the runner blade 30 in an extraordinarily stable manner. In FIG. 4, the lowest part of the runner blade 30 is broken away in order to make the gripping ridges 68 more clearly discernible.

The resilient basic metal of part 66 of the contact blade preferably has a hardness of 700 HV, and may in addition be surface-coated with, for instance, a TiCN coating having a hardness of 3000 HV. This results in extremely low edge wear and a service life of the runner blade 30 that is increased by a factor of 4–5.

The second embodiment of an ice skate boot according to the invention, as illustrated in FIGS. 6–12, essentially differs from the embodiment of FIGS. 1–4 by the differing configuration and fastening of the runner blade 30' and the cooperating fastening parts. Only these differing parts and relationships are discussed below.

In this embodiment the stabilization rail 28' embedded in the base unit 18' has a vertical slot, 48' open and expanding in a downward wedge. A flat ridge 46' of the runner blade 30' that tapers upward correspondingly is inserted into the slot 48'. Along a butt joint 38', the runner blade 30' makes contact with the lower edge of stabilization rail 28' and base unit 18' by means of shoulders 70 projecting outward on both sides.

The transverse opening 60' and the extension 58' of the extended nut 58' having the head 56' are formed conically in this embodiment in the same direction and same manner, so that when tightening the cap screw 54 in the extended nut 58', the wedge-shaped ridge 46' is drawn into the wedge-shaped slot 48' of the stabilization rail 28' with increasing strength and simultaneously the shoulders 70 of the runner blade 30' make close contact with the lower edges of the stabilization rail 28' and the base unit 18'. This makes it possible to achieve a particularly stable connection between the runner blade 30' and the base unit 18'.

The remaining components of this embodiment have essentially the same configuration and mode of operation as the corresponding parts in the embodiment according to FIGS. 1–4 and need not therefore be discussed again. Only the flattening of the wave crests provided on the wave-shaped upper edge 34' of the runner blade 30' need be mentioned.

Figure 10:
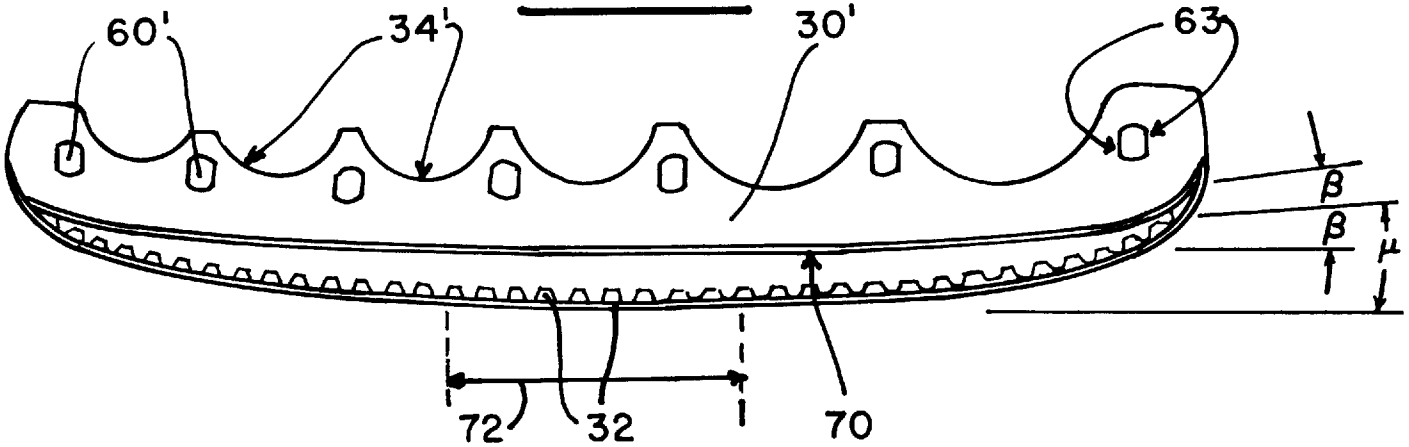
FIG. 10 a schematic side view of the runner blade with contact blade used in the embodiment example according to FIG. 6.

However, it should be pointed out in particular, that based on FIG. 10, by the appropriate shaping of the interchangeable runner blade 30 or 30' the so-called contact surface length 37 [sic] can be freely selected and the so-called contact angle $\alpha$ can be increased or decreased by the angle $\beta$. Moreover, the gliding radius of part 66 can be adjusted according to the nature and hardness of the gliding medium, that is, the ice surface, by increasing or reducing the optimal skating conditions. Depending on the application purpose, different interchangeable blades can therefore be kept on hand and exchanged appropriately, for which only a series of screw connections need be loosened and then retightened in order to achieve an absolutely firm as well as bending- and torsion-resistant seating of the runner blade. The two heads 52 and 56 or 56' here are equipped on the inside with large flat head surfaces in order to draw the runner blade 30 or 30' against the base unit 18 or 18' with high contact pressure. It is practical that the extended nut 58 or 58' consist of light metal or a strong plastic.

Figure 11:
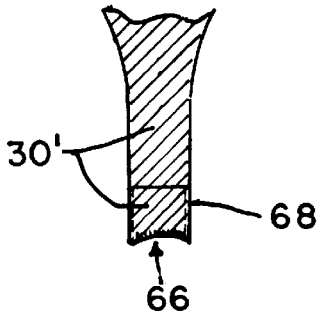
FIG. 11 an enlarged cutout from FIG. 7.
Figure 12:
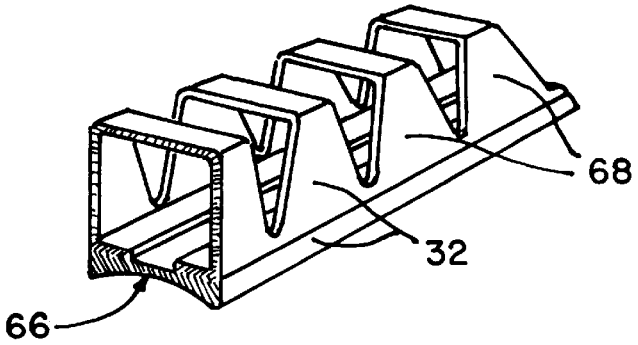
FIG. 12 an enlarged cutout of part of a contact blade according to FIG. 8.

The configuration and anchoring of the gripping ridges 68 are illustrated once again in FIGS. 11 and 12. Of course, other forms of the gripping ridges are possible in principle, with the only points to be observed being the good penetration of the injection molded mass that constitutes the runner blade 30 or 30' into the shapes of the gripping ridges, and sufficient strength of the latter. The connection of the component having the gripping ridges 68 to the resilient component 66 of the contact blade can preferably be accomplished by laser welding.

Figure 13:
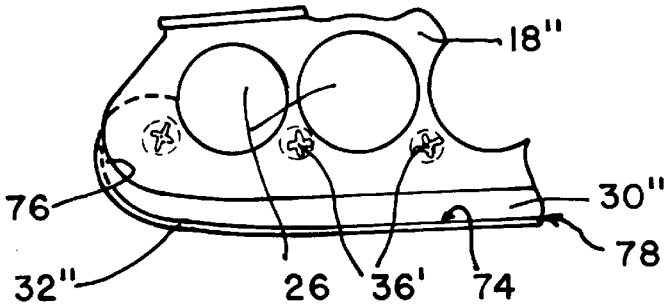
FIG. 13 a partial side view of a part of a runner with adhered contact blade according to a third embodiment of the invention.
Figure 14:
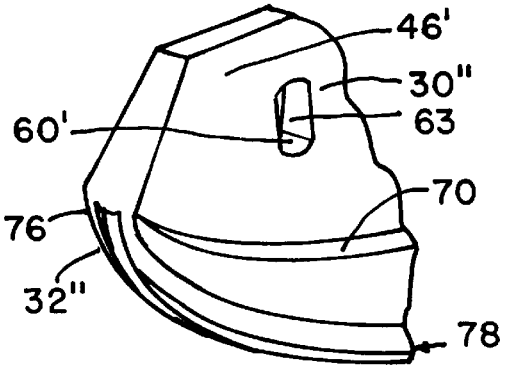
FIG. 14 an enlarged partial side view of the front end of the runner blade according to FIG. 13.
Figure 15:
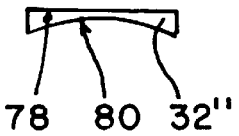
FIG. 15 a cross section through the contact blade used in the embodiment example according to FIG. 13.

FIGS. 13–15 illustrate a third embodiment of the skate runner according to the invention, in which the contact blade 32" is not fastened to the underside 74 of the runner blade 30" by gripping ridges, but rather by adhesion to it. At each end of the contact blade 32", which is bent upwards, the runner blade 30" has a recess 76 to prevent the two ends of the contact blade 32" from sticking out. The adhesion along the adhesion surface 78 is preferably accomplished with an insoluble plastic or metal adhesive in an appropriate gluing device.

The skating radius 80 can generally be chosen as desired in all embodiments.

Figure 16:
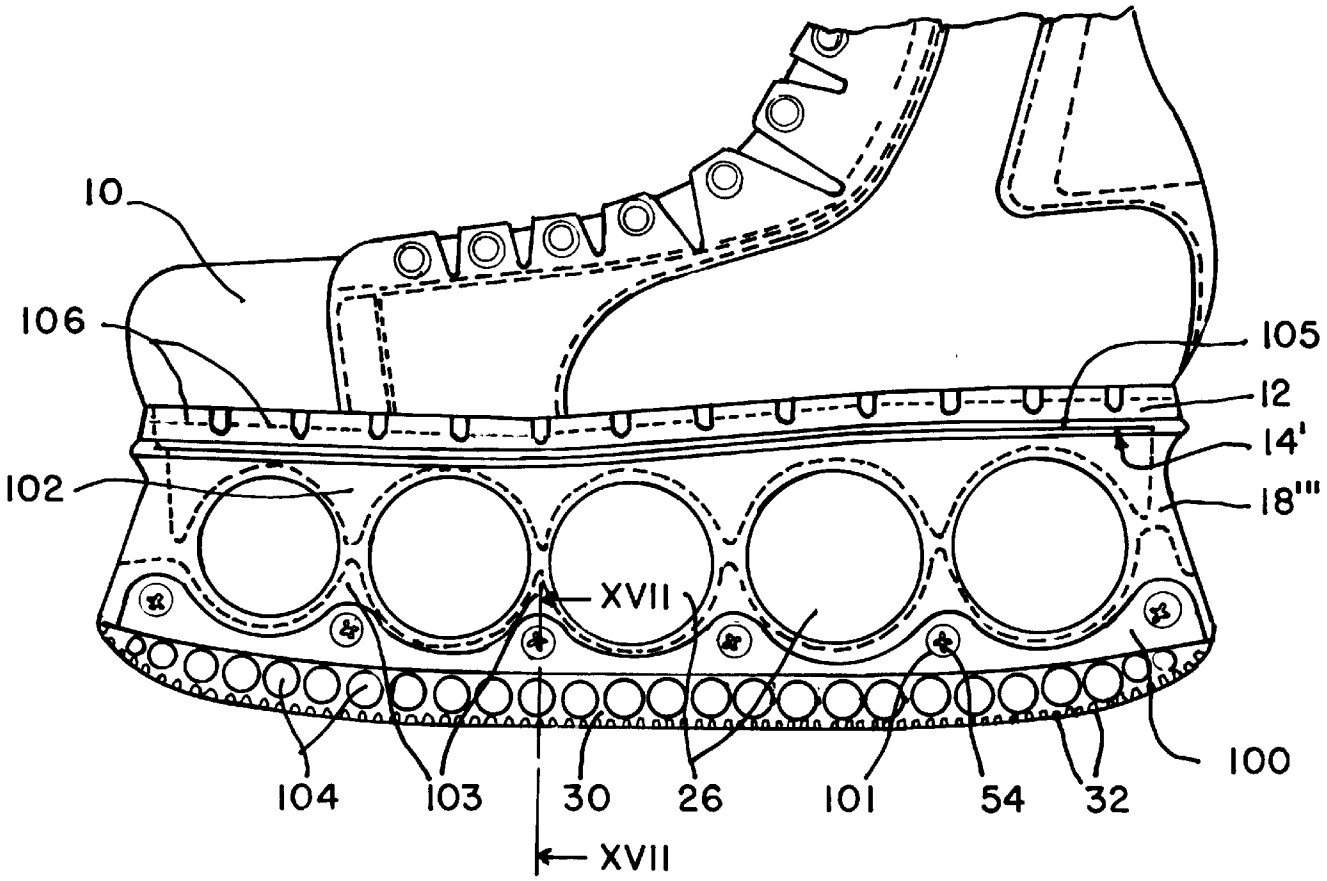
FIG. 16 a schematic side view corresponding to FIG. 1 of a fourth embodiment of an ice skate boot according to the invention.
Figure 18:
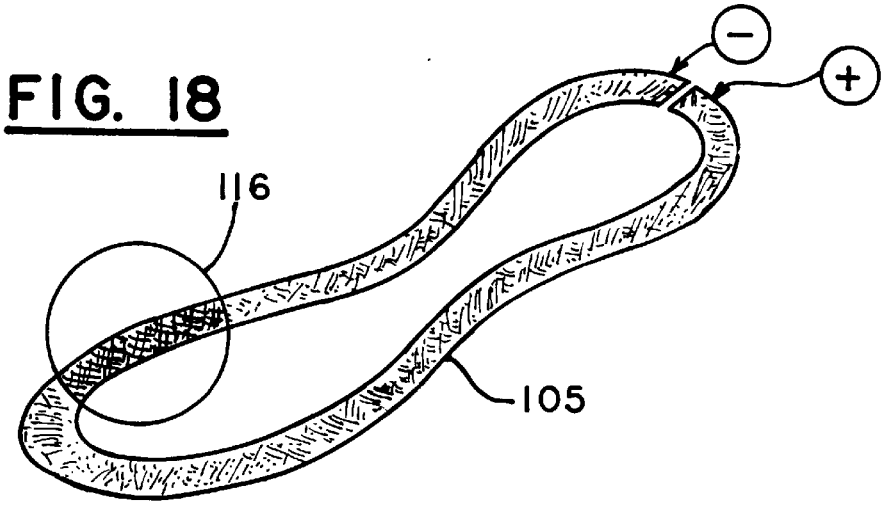
FIG. 18 a schematic oblique view of a thermometallic lattice used in the embodiment according to FIG. 16.
Figure 17:
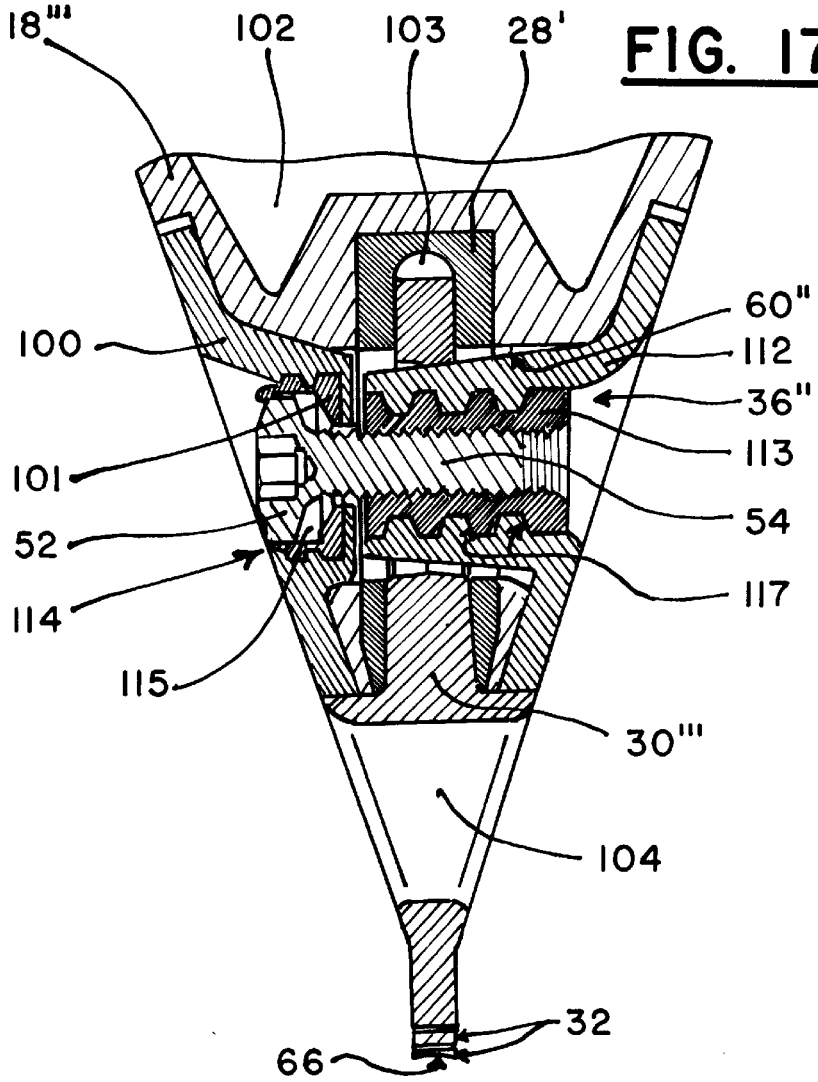
FIG. 17 a partial section along the line XVII—XVII in FIG. 16.

In the embodiment according to FIGS. 16–18, an upturned sole rim 106 from the base unit 18'" surrounds the sole 12 of the ice skate boot 10 and is preferably welded to the sole 12 by means of thermal welding or the like. A strip-like metal grid insert 105, illustrated in FIG. 18, is placed between the sole 12 and sole plate 14' of the base unit 18'". After joining the ice skate boot 10 and the base unit 18'", the metal grid insert 105 can be thermally welded together with sole 12 and sole plate 14'. This thermal welding can be done together with the welding of the sole rim 106. The metal grid insert 105 preferably consists of a fine-mesh thin metal grid, as indicated by 116 in FIG. 18. It can be produced from a copper alloy punched out into a flat band roughly 10 mm wide and laid out in the outline shape of a sole. The two ends + and – are separated and for welding can be connected to the corresponding terminals of an electric power source.

In order to reduce the weight of the base unit 18'" further, cavities 102 are recessed into its upper side and are connected to or open into the transverse cutouts 26 of the base unit 18'", which also serve to reduce the weight.

The weight of the runner blade 30'" can also be reduced by placing a series of tubular transverse cutouts 104 in it.

The assembly of the retaining devices 36" can be made simpler for the embodiment according to FIGS. 16 and 18 by virtue of the fact that a cap screw 54 inserted into a nut 113 is used as the retaining device, with cap screw 54 and nut 113 passing through the transverse opening 60" but not making contact with its walls. Instead, the head 52 of each cap screw 54 is seated in the cavity 115 of a bushing 101 and is prevented from falling out of it by a crimped edge 114, but is able to rotate inside the cavity 115. The bushing 101 is provided with undercuts and the like and is in turn injection-molded into a screw-fitting strip 100 that runs along one side surface of the base unit 18'" from the frontmost to the rearmost retaining device 36". The screw-fitting strip 100 is recessed into the side of the base unit 18'" such that, including the screw heads 52, it lies flush in the side of the base unit 18'". In this way, the cap screws 54 of all retaining devices 36 of a runner are securely held inside the screw-fitting strip 100, making assembly much easier.

In a similar manner, the nuts 113 of all retaining devices 36" on the opposite side of the base unit 18' are injection-molded into a single nut-fitting-strip 112, likewise consisting of plastic, and recessed into the side of the base unit 18' such that, including the nuts, it lies flush in the side of the base unit 18'". For better anchoring in the nut-fitting strip 112, the nuts 114 [sic 113] have radial channels 117 as well as a polygonal cross section, for instance a hexagonal cross section.

The embodiment of a runner blade 30"" shown in FIGS. 19 and 20 has a serrated steel blade 107 that is injection-molded or glued into the front area. The serrated steel blade 107 has teeth 110 projecting downward and frontward. This embodiment is particularly suited for figure skating and general recreational skating.

It is practical that the front part 111 of the contact blade 32 overlap the serrated steel blade 107 so as to provide a better anchoring of the latter in the runner blade 30"". An additional improvement of the anchoring of the serrated steel blade 107 in the runner blade 30"" can be achieved by surrounding the frontmost transverse opening 60' for inserting a retaining device 36' with an anchoring yoke 118 formed as a single piece with the serrated steel blade 107, so that anchoring pressure is also exerted on the serrated steel blade 107 by tightening the retaining device 36'. Moreover, several cutouts 108 of the serrated steel blade 107 also serve for injection and hence, anchoring of the serrated steel blade 107 in the material of the runner blade 30"". A practical lateral support of the serrated steel blade 107 from both sides can be accomplished since the runner blade=30"" has support teeth 109 that extend over the serrated steel blade 107 and project into the middle area of the teeth 110 and are integrally molded piece with runner blade

I claim:

1. A runner, said runner comprising:

a base unit having a top side and a bottom side and an interchangeable runner blade fastened to said bottom side of said base unit, said runner blade including a contact blade on a bottom side of said runner blade, said contact blade having gripping ridges embedded into said runner blade, a stabilization rail integral with the lower side of the base unit, said stabilization rail having an upper edge and a lower edge, said runner blade being in contact with the stabilization rail and wherein a plurality of transverse openings pass through said stabilization rail and said runner blade, respectively, into each of which is inserted a retaining means for holding together the stabilization rail and the runner blade, and said base unit has a series of tubular transverse cutouts for weight reduction, with one transverse opening arranged for the retaining means arranged on each side of each transverse cutout.

2. A runner according to claim 1, wherein said upper edge of the stabilization rail and the upper edge of the runner blade run roughly axially in a wave shape and are adapted to the outlines of the transverse cutout.

3. A runner according to claim 1, wherein each retaining means includes an extended nut, said extended nut having a collar, seated flush in the respective transverse opening and a cap screw, with the heads of said cap screw and extended nut each countersunk into recesses in the outer surface of the runner blade and the base unit and with antirotation surfaces, which cooperate with corresponding surfaces of the transverse opening being provided on the collar of the extended nut.

4. A runner according to claim 3, wherein said transverse opening and the outer surface of the collar of each extended nut are conical.

5. A runner according to claim 11, wherein said runner blade makes contact with lower edges of the base unit and the stabilization rail respectively, by means of shoulders projecting upward.

6. A runner according to claim 1, wherein for additional weight reduction, upwardly opening cavities are recessed into the upper side of the base unit and are connected to the transverse cutouts.

7. A runner according to claim 1, wherein each retaining means includes a cap screw passing through the transverse opening and screwed into a nut, with the cap screws of said retaining means being housed on a single screw-fitting strip that is recessed into the side of the base unit such that, including the heads of cap screws, it lies flush with the side of the base unit and the nuts are held in place inside the transverse openings.

8. A runner according to claim 7, wherein said head of each cap screw is seated so that it is able to rotate in a cavity of a bushing made of light weight metal and equipped at its outer end with a crimped edge, with the bushing being seated so that it is incapable of rotation in the screw-fitting strip.

9. A runner according to claim 8, wherein said screw-fitting strip consists of plastic and the bushing is injected into the screw-fitting strip.

10. A runner according to claim 7, wherein all nuts are held in place in a single nut-fitting strip, which is inserted into a recess of the base unit such that, including the nuts, it lies flush with the side of the base unit.

11. A runner according to claim 10, wherein said nut-fitting strip consists of plastic and the nuts consisting of light weight metal are injection molded into the nut-fitting strip.

12. A runner according to claim 11, wherein said nuts have radial channels and a polygonal cross section.

13. A runner according to claim 1 wherein said gripping ridges are in the form of boxes open in a longitudinal direction of the contact blade and having trapezoidal side faces.

14. A runner comprising:

a base unit having a top side and a bottom side and an interchangeable runner blade fastened to said bottom side of said base unit, said runner blade including a contact blade on a bottom side of said runner blade, said contact blade having gripping ridges embedded into said runner blade, and a stabilization rail integral with the lower side of the base unit, said stabilization rail having an upper edge and a lower edge and wherein said runner blade has a continuous, essentially vertical slot, into which the lower edge of the stabilization rail is inserted.

15. A runner comprising:

a base unit having a top side and a bottom side and an interchangeable runner blade fastened to said bottom side of said base unit, said runner blade including a contact blade on a bottom side of said runner blade, said contact blade having gripping ridges embedded into said runner blade, and a stabilization rail integral with the lower side of the base unit, said stabilization rail having an upper edge and a lower edge and wherein said stabilization rail has a continuous, essentially vertical slot tapering upwards in the form of a wedge, into which is inserted a likewise upward-tapered flat ridge of the runner blade.

16. A runner comprising:

a base unit having a top side and a bottom side and an interchangeable runner blade fastened to said bottom side of said base unit, said runner blade including a contact blade on a bottom side of said runner blade, said contact blade having gripping ridges embedded into said runner blade, and wherein said base unit has a sole rim surrounding the sole of an ice skate boot, said boot is welded to said sole.

17. A runner according to claim 16, wherein a thermally welded grip insert welded together with sole and sole plate is placed between the sole of the ice skate boot and the sole plate of the base unit.

18. A runner comprising:

a base unit having a top side and a bottom side and an interchangeable runner blade fastened to said bottom side of said base unit, said runner blade including a contact blade on a bottom side of said runner blade, said contact blade having gripping ridges embedded into said runner blade, a serrated steel blade with teeth projecting downward and forward is fastened to the forward part of the runner blade, and wherein said runner blade has support teeth that extend over the serrated steel blade and project into the middle area of the teeth of said serrated steel blade.

19. A runner comprising:

a base unit having a top side and a bottom side and an interchangeable runner blade fastened to said bottom side of said base unit, said runner blade including a contact blade on a bottom side of said runner blade, said contact blade having gripping ridges embedded into said runner blade, and a stabilization rail integral with said bottom side of said base unit, a plurality of transverse openings each passing through said stabilization rail and said running blade are provided, and fastening means extending through said transverse openings to hold together said stabilization rail and said running blade.

20. A runner comprising:

a base unit having a top side and a bottom side and an interchangeable runner blade fastened to said bottom side of said base unit, said runner blade including a contact blade on a bottom side of said runner blade, said contact blade having gripping ridges embedded into said runner blade, and wherein said runner blade consists of a lightweight heat insulating material and said contact blade is formed of an extremely thin layer and constitutes the gliding surface of the runner, whereby when the contact blade glides over ice it warms rapidly due to friction and due to the insulating effect of the runner blade the heat in the contact blade does not flow into the runner blade.

21. A runner comprising:

a base unit;

an interchangeable runner blade formed of a light weight material and fastened to said base unit; and a contact blade formed of a hard-resilient material integral to a bottom side of said runner blade, said contact blade having gripping ridges in the form of boxes open in a longitudinal direction of the contact blade and having trapezoidal side faces, said gripping ridges being embedded into the material of said runner blade and penetrated by the material of said runner blade.

22. A runner comprising:

a base unit;

a stabilization rail integral with a lower side of the base unit, said stabilization rail having a slot tapering upwards in the form of a wedge;

a runner blade formed of a light weight material and having a tapered ridge on a top side, said tapered ridge being inserted into said vertical slot of said stabilization rail; and a contact blade formed of a hard resilient material integral to a bottom side of said runner blade, said contact blade having gripping ridges embedded into the material of said runner blade.

23. A runner comprising:

a base unit;

a stabilization rail integral with a lower side of the base unit with a plurality of transverse openings passing therethrough, said stabilization rail having a slot tapering upwards in the form of a wedge;

a runner blade formed of a light weight material with a plurality of transverse openings passing therethrough and having a tapered ridge on a top side, said tapered ridge being inserted into said vertical slot of said stabilization rail whereby said transverse openings in said stabilization rail align with said transverse openings in said runner blade;

a plurality of retaining means for fastening together the stabilization rail and the runner blade, each of said plurality of retaining means extending through one of said transverse openings in said runner blade and one of said transverse openings in said stabilization rail; and a contact blade formed of a hard resilient material integral to a bottom side of said runner blade, said contact blade having gripping ridges embedded into the material of said runner blade.

* * * * *

UNITED STATES PATENT AND TRADEMARK OFFICE

CERTIFICATE OF CORRECTION

PATENT NO. : 5,769,434

DATED : June 23, 1998

INVENTOR(S) : Holger Wurthner

It is certified that error appears in the above-identified patent and that said Letters Patent is hereby corrected as shown below:

Claim 5, line 1, replace "11" with --4--.

Signed and Sealed this

Twenty-second Day of September, 1998

*Attest:*

Bruce Lehman

BRUCE LEHMAN

*Attesting Officer*

*Commissioner of Patents and Trademarks*